US008533055B1

(12) United States Patent
Brazil et al.

(10) Patent No.: US 8,533,055 B1
(45) Date of Patent: Sep. 10, 2013

(54) TRADE-IN PHOTO DOCUMENTATION

(75) Inventors: Silas M. Brazil, Seattle, WA (US); Sandeep Bodapati, Seattle, WA (US); Maurice Codik Moscoso, Seattle, WA (US); Ranjeet S. Sonone, Kent, WA (US)

(73) Assignee: Amazon Technologies, Inc., Reno, NV (US)

( * ) Notice: Subject to any disclaimer, the term of this patent is extended or adjusted under 35 U.S.C. 154(b) by 22 days.

(21) Appl. No.: 13/172,071

(22) Filed: Jun. 29, 2011

(51) Int. Cl.
*G06Q 30/00* (2012.01)

(52) U.S. Cl.
USPC ..... 705/26.1

(58) Field of Classification Search
USPC ..... 705/26.1, 27.1
See application file for complete search history.

(56) References Cited

U.S. PATENT DOCUMENTS

| | | | | |
|---|---|---|---|---|
| 2004/0114035 | A1* | 6/2004 | White | 348/131 |
| 2004/0117319 | A1* | 6/2004 | Oshima et al. | 705/75 |
| 2008/0077542 | A1* | 3/2008 | McElhiney et al. | 705/400 |
| 2008/0230402 | A1* | 9/2008 | Macor | 206/81 |

OTHER PUBLICATIONS

Gilroy, A, Tom Tom launches cash for old PNDs trade-in program, TWICE, Dec. 7, 2009.*

* cited by examiner

*Primary Examiner* — Brandy A Zukanovich
(74) *Attorney, Agent, or Firm* — Thomas Horstemeyer, LLP

(57) ABSTRACT

Disclosed are various embodiments for an inspection system and method that automatically photographs or captures video footage of received items for trade-in as they are being inspected or graded.

20 Claims, 8 Drawing Sheets

Your Item Has Been Rejected 402

Your item in trade-in order number 55779111022 has been rejected.

Reason: Incorrect edition

Only items that match the exact version displayed in our Amazon Trade-In Store is eligible for for trade-in.

The title of the book in our Amazon Trade-In Store is Calculus 101.

TRADE-IN PHOTO DOCUMENTATION

BACKGROUND

One type of interactive electronic commerce system available to users is online trade-in stores. Accordingly, web sites have arisen that allow users to sell items, such as DVD (Digital Versatile Disc) movies, audio CDs (Compact Discs), or video games. Generally, a user may visit a web site hosting the online trade-in store and search a catalog of items that the store is interested in purchasing from users. The user will typically register with the store to become a customer by entering personal information, such as the user's name, mailing address, and payment information. Once registered, the customer can make a trade-in request. For example, if the user, after searching the catalog, finds an item listed in the catalog that is also currently owned by the user, then the user may add the item to his or her virtual shopping cart and agree to sell the item to the store. Thereafter, the customer will need to physically ship the item to the store and wait to receive compensation or credit for the item from an operator of the trade-in store. However, before compensation is provided, received items are reviewed to determine whether or not they pass inspection. Possible reasons for being rejected include an item being non-working; the item not matching the trade-in item requested; the item being damaged, etc.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

In the following discussion, a general description of an online trade-in system and its components is provided, followed by a discussion of the operation of the same. The discussion relates to an inspection system and method that automatically photographs or captures video footage of received items for trade-in as they are being inspected, where a condition of the item as received is assessed or graded. The photo image or video documentation is automatically cataloged and made available to the customer who sent the item and other interested parties, such as a customer service representative. In this way, if the customer calls the customer service representative to discuss the rejection, they can both have photo documentation of the item showing the part or aspect of the item that caused the item to be rejected or downgraded. The photo documentation may also be made available to store management to allow for any mistakes made by the inspector to be audited so that inspector can improve his or her performance.

Figure 1:
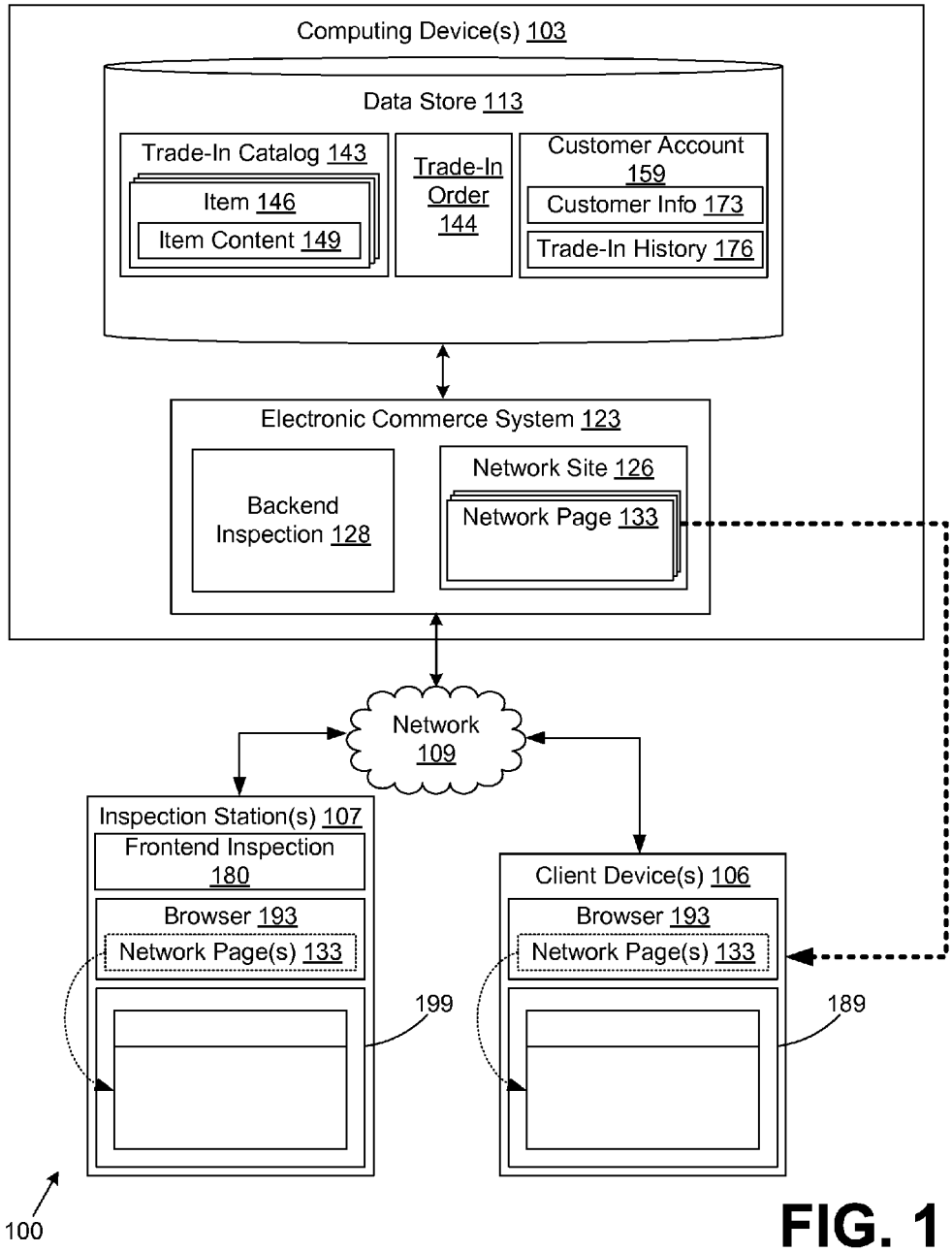
FIG. 1 is a drawing of a networked environment according to various embodiments of the present disclosure.

With reference to FIG. 1, shown is a networked environment 100 according to various embodiments. The networked environment 100 includes one or more computing devices 103 that are coupled to one or more client devices 106 and inspection stations 107 through a network 109. The network 109 includes, for example, the Internet, intranets, extranets, wide area networks (WANs), local area networks (LANs), wired networks, wireless networks, or other suitable networks, etc., or any combination of two or more such networks.

The computing device 103 may comprise, for example, a server computer or any other system providing computing capability. Alternatively, a plurality of computing devices 103 may be employed that are arranged, for example, in one or more server banks or computer banks or other arrangements. For example, a plurality of computing devices 103 together may comprise a cloud computing resource, a grid computing resource, and/or any other distributed computing arrangement. Such computing devices 103 may be located in a single installation or may be distributed among many different geographical locations. For purposes of convenience, the computing device 103 is referred to herein in the singular. Even though the computing device is referred to in the singular, it is understood that a plurality of computing devices 103 may be employed in the various arrangements as described above.

Various applications and/or other functionality may be executed in the computing device 103 according to various embodiments. Also, various data is stored in a data store 113 that is accessible to the computing device 103. The data store 113 may be representative of a plurality of data stores as can be appreciated, such as data store(s) dedicated to the online trade-in store. The data stored in the data store 113, for example, is associated with the operation of the various applications and/or functional entities described below.

The components executed on the computing device 103, for example, include an electronic commerce system 123 and other applications, services, processes, systems, engines, or functionality not discussed in detail herein. The electronic commerce system 123 facilitates a network site 126 such as, for example, a website or other network presence, for the online trade-in store. The electronic commerce system 123 includes a backend inspection application 128 and/or other applications that are executed to generate various network pages 133 of the network site 126 and perform other functions as will be discussed. Further, a frontend inspection application 180 is executed by an inspection station 107 and works in concert with the backend inspection application 128.

A network page 133 may include code that generates dynamic network pages when executed or interpreted in the client device 106. The code may be written in any suitable programming language such as, for example, PHP (Hypertext Preprocessor), Perl, Objective C, Java, Ruby, etc. Also, the network pages 133 may also include code configured to be executed or interpreted within the client device 106 in order to facilitate dynamic rendering of the network page 133. Such code may be referred to as an executable and may be written in any suitable programming language such as, for example, Java Script, Java, or other languages.

Network pages 133 may also include static elements that may be expressed, for example, in hypertext markup language (HTML), extensible markup language (XML), and/or any other language suitable for creating network pages 133.

The data stored in the data store 113 includes, for example, a trade-in item catalog 143 that includes a listing of items 146 being accepted for trade-in by the online trade-in store. Associated with each item 146 is item content 149 that may comprise, for example, information about an item 146 such as images, text descriptions, attributes, trade-in values, and other information.

The data stored in the data store 113 further includes, for example, a trade-in order database 144 that includes various outstanding trade-in orders or requests from customers. In addition, stored on the data store 113 are customer accounts 159. Each customer account 159 includes various customer data such as customer information 173, a trade-in history 176, and other information. In addition to the foregoing, there may be other data stored in the data store 113 as well.

The customer information 173 may comprise, for example, customer names, billing addresses, shipping addresses, payment instrument information, electronic mail addresses, and other information as can be appreciated. The trade-in history 176 comprises a history of the interaction of a given customer with the electronic commerce system 123 in selling items to the online trade-in store over time.

The electronic commerce system 123 is executed in order to facilitate the online selling of items from customers over the network 109. For example, the electronic commerce system 123 generates one or more network pages 133 for the online trade-in store, such as web pages or other types of network content that are provided to client(s) 106 in response to various requests for the purposes of selecting items for trade-in.

The backend inspection application 128 (and a frontend inspection application 180) is executed as part of the electronic commerce system 123 in order to provide for the inspection of and grading of conditions of items that are being submitted for trade-in by customers as will be described. After inspection of trade-in item(s) associated with an order, a customer is notified of the status of the order and credited compensation, as circumstances warrant. In some embodiments, each item listed in a trade-in order has to pass inspection before any compensation is provided for the customer who submitted the order.

The inspection station 107 is representative of a plurality of client inspection stations that may be coupled to the network 109. The inspection stations 107 may comprise, for example, a processor-based system such as a computer system. The inspection station 107 includes, for example, a display device 199 such as a cathode ray tube, a liquid crystal display, or other type of display device as can be appreciated. The inspection station 107 further includes an image capture device such as a digital camera and/or video camera. Other peripheral devices, such as a bar code scanner, a printer, etc., may also be coupled to the inspection station 107 and may also be included in an inspector's work area.

The client computing device 106 also is representative of a plurality of client devices that may be coupled to the network 109. The client computing device 106 may comprise, for example, a processor-based system such as a computer system. Such a computer system may be embodied in the form of a desktop computer, a laptop computer, a personal digital assistant, a cellular telephone, a set-top box, music players, web pads, tablet computer systems, game consoles, or other devices with like capability. The client computing device 106 includes, for example, a display device 189 such as a cathode ray tube, a liquid crystal display, or other type of display device as can be appreciated.

The client computing device 106 and/or inspection station 107 may be configured to execute various applications such as a browser 193 and/or other applications. The browser 193 or other client application is executed in the client computing device 106 and/or inspection station 107, for example, to access and render network pages 133, such as web pages, or other network content that is rendered, for example, on the display device 189, 199. Such network pages 133 and other content are served up to the device 106, 107 by the computing device 103 and/or other servers. The client computing device 106 and/or inspection station 107 may be configured to execute applications beyond the browser 193 such as, for example, email applications, instant message applications, and/or other applications.

Figure 2:
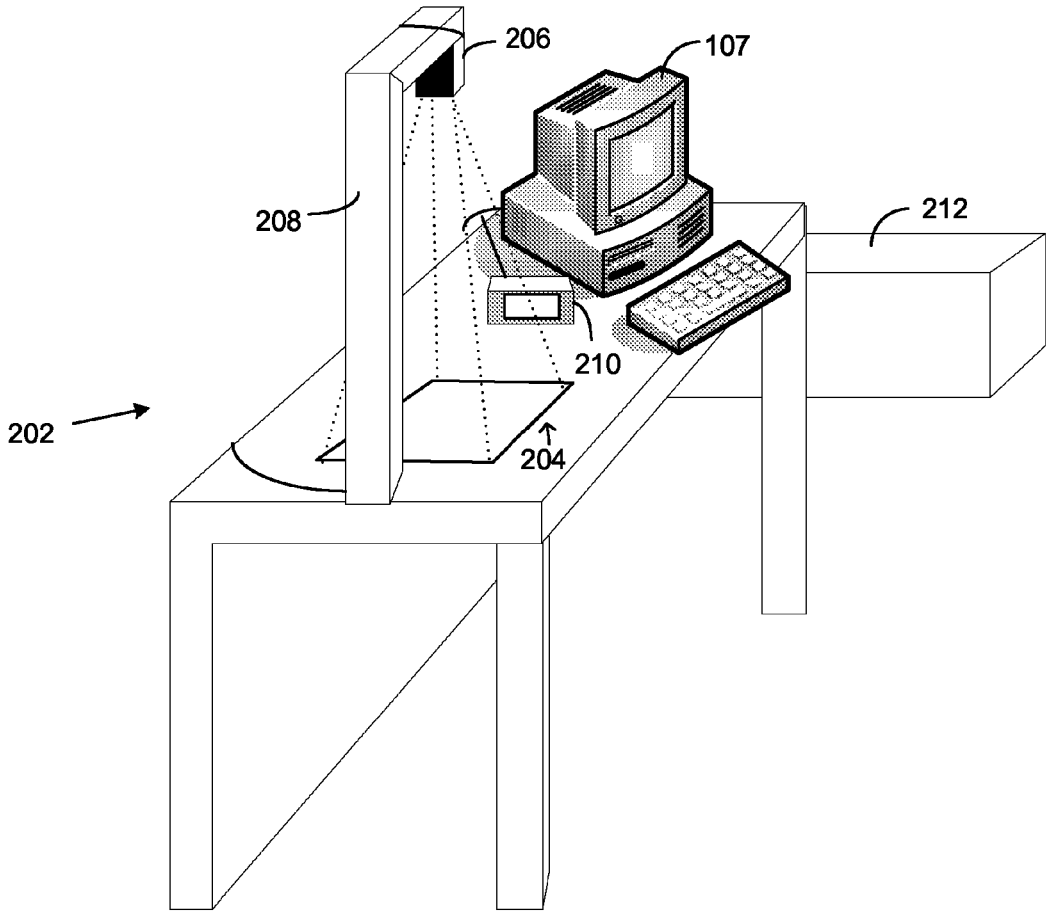
FIG. 2 is a drawing of an exemplary work area having an inspection station of FIG. 1 according to various embodiments of the present disclosure.

In the discussion that follows with respect to FIG. 2, one embodiment of a work area for an inspector is represented. It is understood that the components discussed in the work area are merely examples of the many different types of components that may be employed to achieve the same functionality. Referring to FIG. 2, a work area for an inspector or grader of submitted trade-in items 146 (FIG. 1) is depicted. The work area includes a table or flat surface 202 upon which an item being reviewed is placed and evaluated. In this deployment, guide marks or an outline 204 are placed on the flat surface, as will be explained. Also, an image capture device 206 is mounted over the table above the guide marks (or outline) 204 via a support structure, such as a pedestal 208. The inspection station 107 is also located in the work area next to or on top of the table and is coupled to the image capture device 206. Also, coupled to the inspection station 107 is a bar code scanner 210 which is located next to the table. Items waiting to be inspected by the inspector may also be located in a cart, rack, a conveyor system 212, or stacked in or near the work area.

The inspection station 107 executes a client or frontend version of the inspection application 180 (FIG. 1) which is in communication with the backend inspection application 128 (FIG. 1) at computing device 103 (FIG. 1). At the inspection station 107, the inspector is provided a graphical interface for grading a quality or condition of a recently received item that has been sent by a customer for trade-in.

Figure 3:
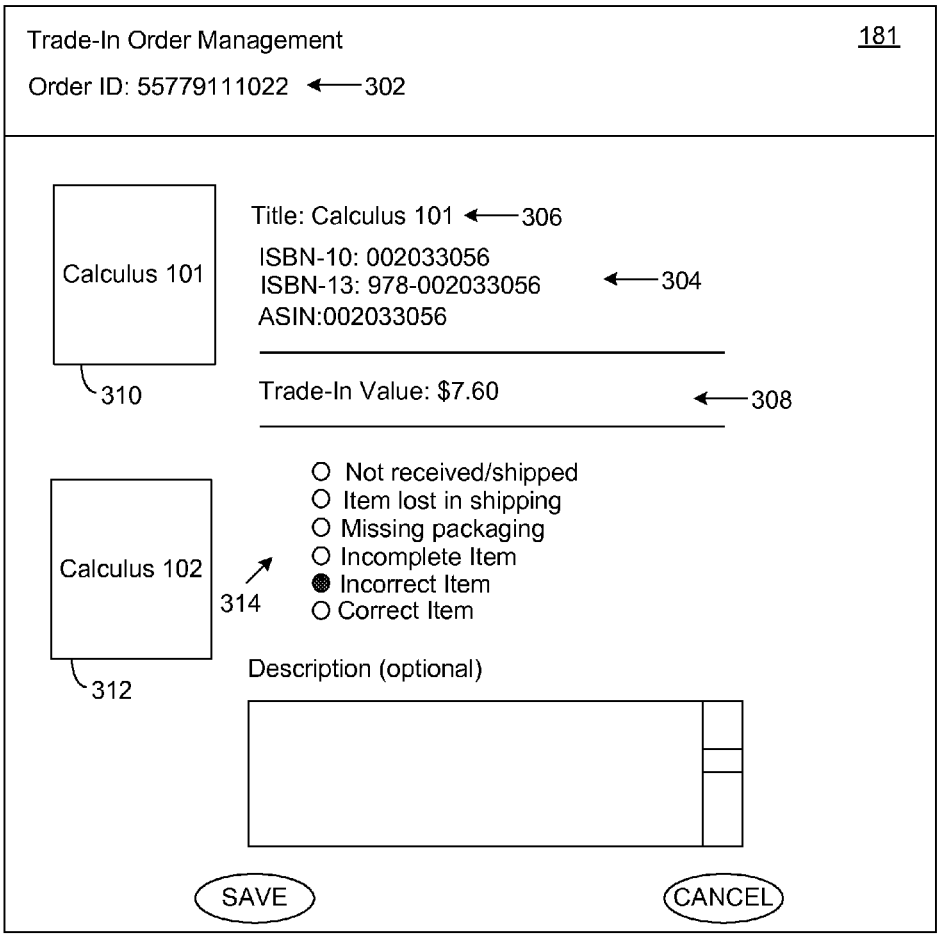
FIG. 3 is a drawing of an exemplary user interface rendered by an inspection station of FIG. 1 according to various embodiments of the present disclosure.
Figure 4:
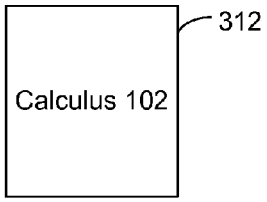
FIG. 4 is a drawing of an exemplary notification message embedded with a captured image according to various embodiments of the present disclosure.
Figure 5:
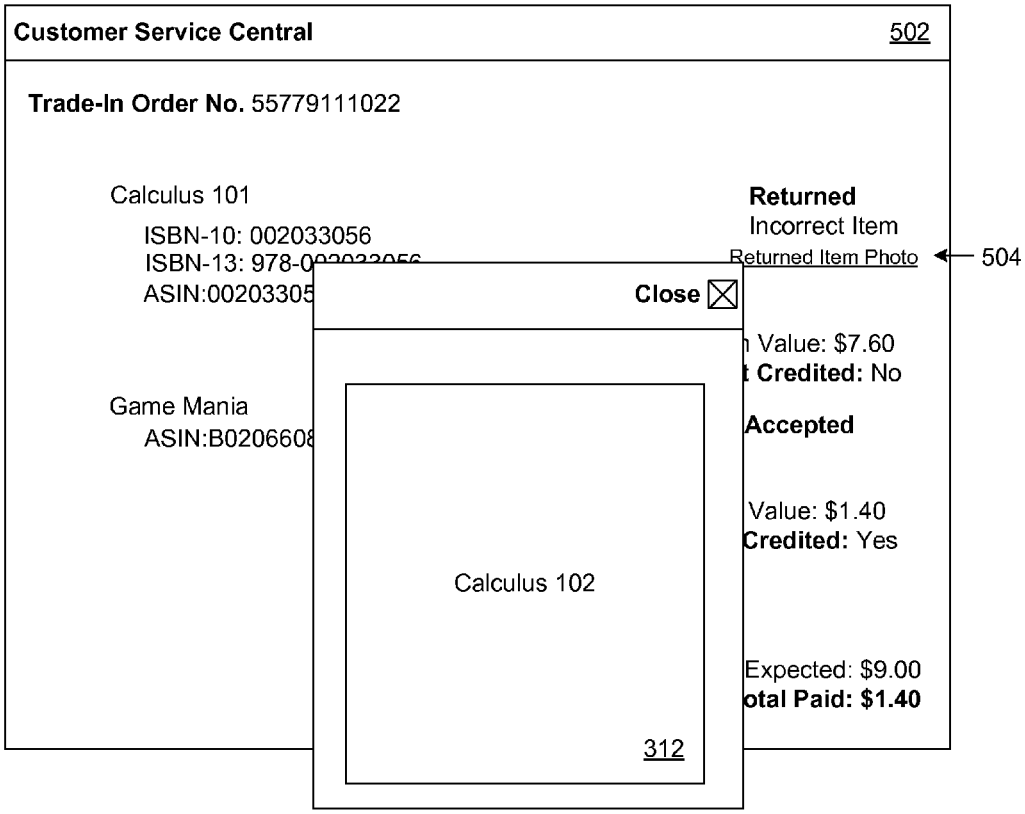
FIG. 5 is a drawing of an exemplary interface screen for a trade-in order database that accesses a captured image according to various embodiments of the present disclosure.

In the discussion that follows with respect to FIGS. 3-5, various graphical user interface components are described such as push buttons, text fields, and the like. It is understood that these components are merely examples of the many different types of components that may be employed to achieve the same functionality. In discussing the figures, a general description of the operation of the various components of the networked environment 100 (FIG. 1) is also provided.

As shown in FIG. 3, the frontend trade-in application 180 (FIG. 1) provides a graphical interface 181 in which to interact with a viewer of the network page 133 (FIG. 1). The graphical interface 181 displays information and invites the viewer or user to act in a number of ways. In some embodiments, the graphical interface includes buttons, dialog boxes, pop-up windows, pull-down menus, icons, scroll bars, resizable window edges, progress indicators, selection boxes, windows, tear-off menus, menu bars, toggle switches and forms.

In FIG. 3, one embodiment of the graphical interface 181 for grading a quality or condition of a trade-in item is depicted. Generally, the inspector may select an item to be evaluated or reviewed and scan a tag attached to the item having a barcode via the barcode scanner 210 (FIG. 2). The barcode contains the order number or code for the trade-in request. Accordingly, pertinent information from the corresponding trade-in order is retrieved from the trade-in database 144 (FIG. 1) and displayed on the graphical interface 181, including an order number 302, a serial or product number (e.g., International Standard Book Number (ISBN)) 304 of the subject of the trade-in request, item title 306, the trade-in value 308, etc. Also, a model or ideal image 310 of the item may be displayed, where the model image does not contain any imperfections or degradations. This can be used as a point of reference or comparison by the inspector in evaluating the item under review. In one embodiment, the ideal image 310 may be presented in a side by side comparison (or top to bottom comparison) with the image 312 (e.g., an image showing an incorrect book) captured by the image capture device 206 (FIG. 2) during inspection.

Further, during inspection, images 312 from the image capture device 206 (FIG. 2) may also be visible on the interface screen 181 of the frontend inspection application 107 (FIG. 2) below the ideal image 310 but are not captured until further action by the inspector. In this way, the inspector could reference the live images being shown on the inspection station 107 (FIG. 2) to verify that the item is being depicted as the inspector intends. For example, the inspector may view the live images to make sure a flaw or damage in the item should be evident in an image capture.

Accordingly, the inspector will review the item and then select one of the choices 314 listed in the graphical interface 181 for the item, where the choices represent different possible conditions or levels of quality.

Often, a customer may choose the condition of the item that the customer is submitting for trade-in, where a lower amount is paid for items being in lower conditions. To illustrate, for electronics items, a customer may be able to choose the item condition to be "Like New," "Good," or "Acceptable." For video games or movie media, the customer may be able to choose the item condition to be "Good" or "Acceptable." Also, only one condition may be accepted corresponding to "Good" for certain categories of products, such as books.

Therefore, an inspector may review a received item from a customer and determine whether or not the condition of the item matches the stated condition alleged by the customer. If the condition of the item is at a lower quality than the stated condition, the trade-in item request may be considered to be rejected and/or downgraded. However, although a condition is downgraded, the assessed condition may be above a stated or specified threshold as to an acceptable condition for the item to be eligible for trade-in. For example, in one scenario, the minimum level of quality of an item that is being accepted for one category of items may be "Good." An inspector may therefore have an item to be evaluated, where the person who sent the item for trade-in assessed the item as being "Like New." After reviewing the item, the inspector may determine that the condition of the item is "Good" and not "Like New." Therefore, the inspector will downgrade a condition of the item, but the item is not rejected. A consequence of the item being downgraded in this scenario may be that a trade-in value for the item is also downgraded to a lesser value. If the condition of the item was downgraded to a level below "Good," then the item would have been rejected.

Possible flaws or damages that may cause electronics items to be rejected or downgraded include water damage, inability to power on, and other severe damage that causes the item to be unusable. For books, a rejected item may have an ISBN that does not match the ISBN of the desired item, have torn or missing pages, damaged spine, a damaged cover, and may be missing supplemental materials, among others.

Accordingly, if the inspector selects a condition, via the graphical interface 181, that causes the item to be rejected, the image capture device 206 is triggered to capture an image or video feed. In this example, the item being graded is a book where the book is either in acceptable condition or is not. If the item passes inspection, then the choice corresponding to "Correct Item" may be selected. Otherwise, one of the other choices may be selected which signifies that the item is rejected.

In one embodiment, upon selection of one of the other choices that causes the item to fail inspection or be downgraded from an initially assessed condition set by the customer, the image capture device 206 (e.g., a high resolution digital camera) takes an image of the item that is positioned between the guide marks or outline 204 (FIG. 2) in the workspace. The captured image (or video footage, as the case may be) is cataloged or indexed with the order information so that it may be reviewed along with the order information at a later time. Therefore, instead of having to annotate reasons and explanations for rejected items, the reason for a rejection may be plainly seen in the captured image or video, in a majority of cases.

As discussed above, the image capture device 206 is focused on the area delineated by the guide marks or outline 204 on the flat work surface 202 (FIG. 2). However, the inspector may also be provided with options on the frontend inspection application 180 to widen the field of view of the image capture device 206, if necessary, to accommodate the inspector's workspace needs. Also, the inspector may be provided the option to retake an image should a mistake be made. For example, the frontend inspection application 180 may provide a button allowing for corrected grading on the graphical interface 181.

After grading an item, the inspection applications 128, 180 (FIG. 1) may cause a notification message to be sent to the customer with the graded condition of the item. In FIG. 4, one embodiment of a notification message 402 is depicted. The message 402 contains an image of the item (or video) 312 with additional details about the graded condition or rejection, if the item is rejected. The image 312 may be embedded in the message or a hypertext link may be provided to a location on the network 109 (FIG. 1) to view the image. Since not understanding the basis for rejecting an item is often a source of dissatisfaction with trade-in programs, providing an image 312 of the item to the customer should help improve the customer experience.

Further, the captured image 312 may also improve the ability of customer service representatives to communicate with customers about rejected items. Accordingly, FIG. 5 depicts one embodiment of an interface screen 502 that accesses the trade-in order database 144 (FIG. 1). The screen 502 shows the items that are part of a particular trade-in order, where the item description for the trade-in order contains the title "Calculus 101" but the item that has been received from the customer that submitted the order contains the title "Calculus 102." In reviewing the status of this matter, a customer service representative is provided a link 504 to a captured image 312 (e.g., a cover of a book showing the book's title) that was obtained during grading or inspection of the particular item. Accordingly, the representative may view the image 312 by accessing the link 504.

Therefore, if both the customer and the customer service representative are looking at the same image 312 while discussing the customer's issues, it can only improve communication and help the customer service representative make an informed judgment. Such captured images may also be helpful in evaluating the performance of the inspectors themselves by providing visibility in their job performance.

Figure 6:
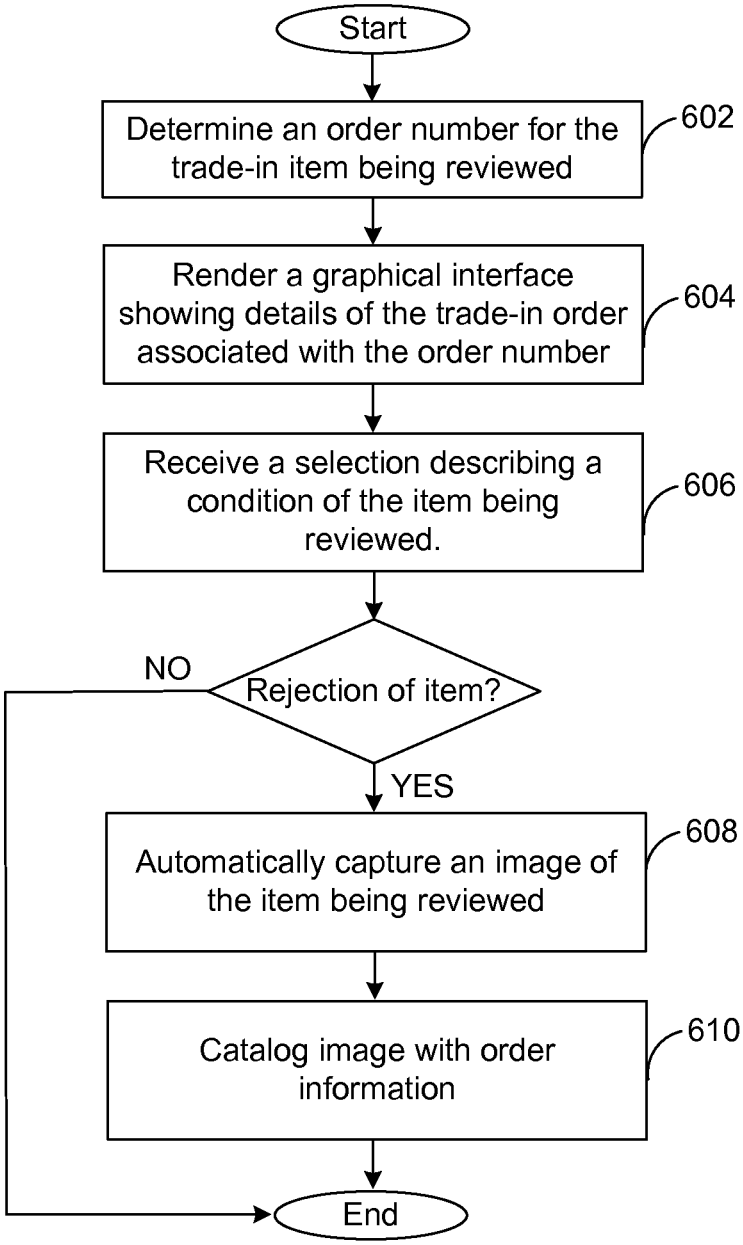
FIGS. 6-7 are flowchart illustrating examples of functionality implemented as portions of inspection logic executed in computing devices in the network environment of FIG. 1 according to various embodiments of the present disclosure.

Referring next to FIG. 6, shown is a flowchart that provides one example of the operation of a portion of the inspection logic (frontend inspection application 180 (FIG. 1) and backend inspection application 128 (FIG. 1)) as a portion of the electronic commerce system 123 (FIG. 1) according to various embodiments. It is understood that the flowchart of FIG. 6 provides merely an example of the many different types of functional arrangements that may be employed to implement the operation of the portion of the inspection logic as described herein. As an alternative, the flowchart of FIG. 6 may be viewed as depicting an example of steps of a method implemented in the computing device 103 (FIG. 1) and/or inspection station 107 (FIG. 1) according to one or more embodiments.

The flowchart of FIG. 6 illustrates functionality or steps that are implemented when an inspector scans a barcode tag of a trade-in item that has been received from a customer and is to be graded by the inspector. The flowchart includes functionality or steps implemented when the user clicks on a selected condition option 314 (FIG. 3). Beginning with box 602, the inspection logic 128, 180 first determines an order number for the trade-in item being reviewed. In box 604, the inspection logic 128, 180 renders or displays a graphical interface showing details of the trade-in order associated with the order number. The details may include customer information and information on the trade-in items that are the subject of the order.

Accordingly, the inspector will review the item and then select one of the choices listed in the graphical interface 181 (FIG. 3) for the item, where the choices represent different possible conditions or levels of quality of the item as received. Therefore, an inspector may review a received item from a customer and determine whether or not the condition of the item matches the stated condition alleged by the customer. If the condition of the item is at a lower quality than the stated condition, the trade-in item request may be considered to be rejected or downgraded. As a result, in box 606, the inspection logic 128, 180 receives the selection made by the inspector.

In one embodiment, upon selection of one of the other choices that causes the item to fail inspection or be downgraded from an initially assessed condition set by the customer, the image capture device 206 (FIG. 2) is triggered to take an image of the item that is positioned between the guide marks or outline 204 (FIG. 2) on a work surface, in box 608. The captured image (or video footage, as the case may be) is cataloged or indexed with the order information so that it may be reviewed along with the order information at a later time, in box 610. For example, the order item number for the damaged or rejected item may be recorded. As a result, instead of having to annotate reasons and explanations for rejected items, the reason for a rejection is plainly visible in the captured image or video, in a majority of cases.

Figure 7:
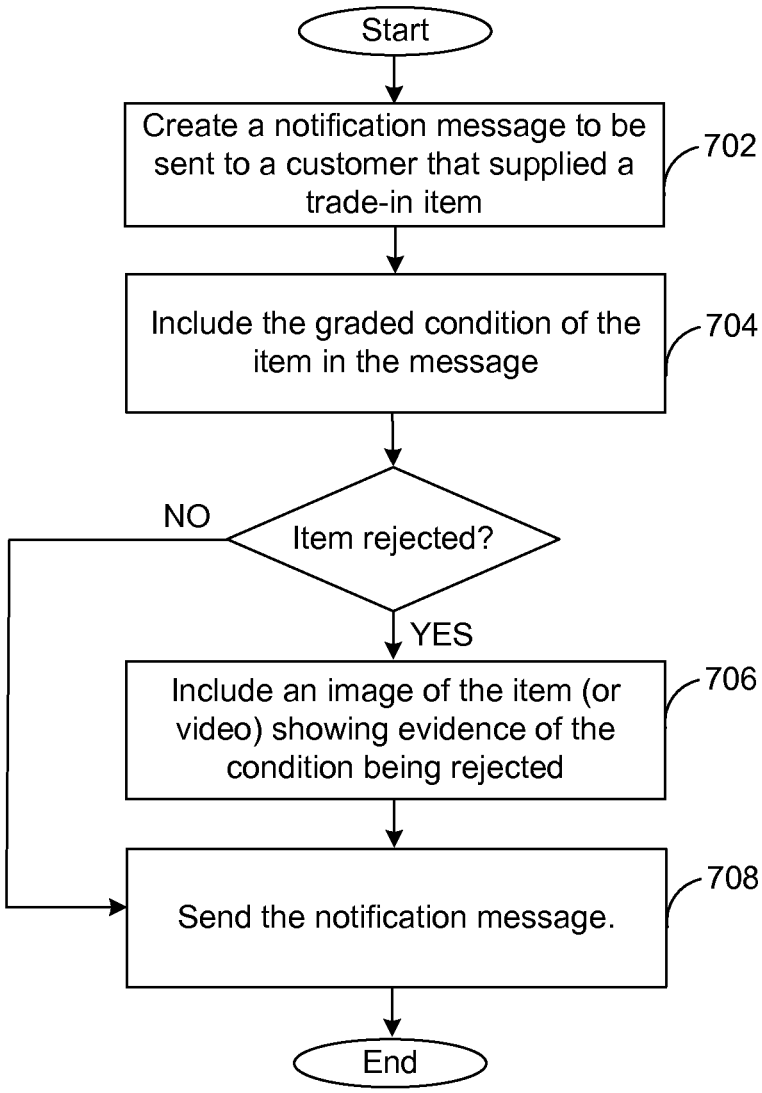

Referring next to FIG. 7, shown is a flowchart that provides one example of the operation of another portion of the inspection logic 128, 180 (FIG. 1) as a portion of the electronic commerce system 123 (FIG. 1) according to various embodiments. It is understood that the flowchart of FIG. 7 provides merely an example of the many different types of functional arrangements that may be employed to implement the operation of the portion of the inspection logic 128, 180 as described herein. As an alternative, the flowchart of FIG. 7 may be viewed as depicting an example of steps of a method implemented in the computing device 103 (FIG. 1) and/or inspection station 107 (FIG. 1) according to one or more embodiments.

To begin, in box 702, the inspection logic 128, 180, after receiving a graded condition for a trade-in item from a customer, creates a notification message to be sent to a customer that supplied a trade-in item. The notification message includes the graded condition of the item, in box 704. If the graded condition caused the item to be rejected as being eligible for trade-in, the message is included with an image of the item (or video) showing evidence with the condition causing the item to be rejected, in box 706. The image may be embedded in the message or a hypertext link may be provided to a location on the network to view the image. Further, additional details may be included in the message about the graded condition or rejection. After the message is composed, the notification message is sent to the customer, in box 708.

Accordingly, in some embodiments, the image capture device 206 may be a high resolution camera used to automatically capture an image of the item being reviewed that shows why the item is being rejected or downgraded (e.g., a physical defect, incorrect item, missing parts, etc.) without the inspector having to handle the camera itself or interfering with the inspector's workspace. The captured image may be stored in a data store 113 (FIG. 1) of a network 109 (FIG. 1) and made available to a customer to view in his or her account to the trade-in store for a defined period. The same image may also be made available to customer service representatives to aid in handling potential customer contacts and can be made available to processor supervisors or store management should they need to review an inspector's performance. As such, the image may communicate a reason as to why an item is rejected and be more effective than attempts to explain reasons for a rejection in a letter or message. Further, by providing access to an ideal image of the product item, a point of comparison may be made to show how the rejected item differs from an undamaged item and the flaws or imperfections prevalent therein.

In some embodiments, an image may also be captured when an item is not rejected. For example, whenever the inspector selects a condition grade for the item, an image may be automatically captured, since the image may later be found to be useful. Correspondingly, video footage may be captured in some situations instead of image capture. To illustrate, if the item being reviewed is a television display and the audio from the display is not functioning, then a video capture of the television display (having an audio stream) in operation is more useful than an image capture. In various embodiments, when capturing video, the inspector may have to manually start and/or stop the video feed using the frontend inspection application 180, in some embodiments.

Figure 8:
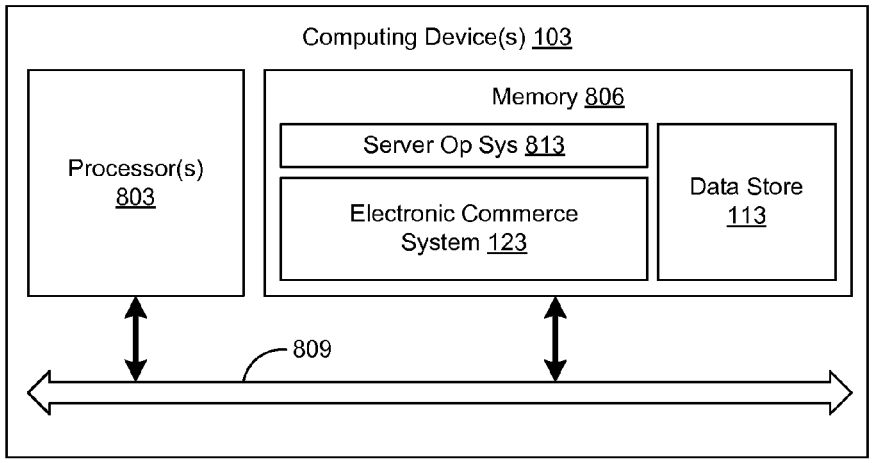
FIG. 8 is a schematic block diagram that provides one example illustration of a computing device employed in the networked environment of FIG. 1 according to various embodiments of the present disclosure.

With reference to FIG. 8, shown is a schematic block diagram of the computing device 103 according to an embodiment of the present disclosure. The computing device 103 includes at least one processor circuit, for example, having a processor 803 and a memory 806, both of which are coupled to a local interface 809. To this end, the computing device 103 may comprise, for example, at least one server computer or like device. The local interface 809 may comprise, for example, a data bus with an accompanying address/control bus or other bus structure as can be appreciated.

Stored in the memory 806 are both data and several components that are executable by the processor 803. In particular, stored in the memory 806 and executable by the processor 803 are the electronic commerce system 123 including the inspection logic 128, 180 (FIG. 1), and potentially other applications. Also stored in the memory 806 may be a data store 113 and other data. In addition, an operating system 813 may be stored in the memory 806 and executable by the processor 803.

It is understood that there may be other applications that are stored in the memory 806 and are executable by the processors 803 as can be appreciated. Where any component discussed herein is implemented in the form of software, any one of a number of programming languages may be employed such as, for example, C, C++, C#, Objective C, Java, JavaScript, Perl, PHP, Visual Basic, Python, Ruby, Delphi, Flash, or other programming languages.

A number of software components are stored in the memory 806 and are executable by the processor 803. In this respect, the term "executable" means a program file that is in a form that can ultimately be run by the processor 803. Examples of executable programs may be, for example, a compiled program that can be translated into machine code in a format that can be loaded into a random access portion of the memory 806 and run by the processor 803, source code that may be expressed in proper format such as object code that is capable of being loaded into a random access portion of the memory 806 and executed by the processor 803, or source code that may be interpreted by another executable program to generate instructions in a random access portion of the memory 806 to be executed by the processor 803, etc. An executable program may be stored in any portion or component of the memory 806 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 806 is defined herein as including both volatile and nonvolatile memory and data storage components. Volatile components are those that do not retain data values upon loss of power. Nonvolatile components are those that retain data upon a loss of power. Thus, the memory 806 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 803 may represent multiple processors 803 and the memory 806 may represent multiple memories 806 that operate in parallel processing circuits, respectively. In such a case, the local interface 809 may be an appropriate network that facilitates communication between any two of the multiple processors 803, between any processor 803 and any of the memories 806, or between any two of the memories 806, etc. The local interface 809 may comprise additional systems designed to coordinate this communication, including, for example, performing load balancing. The processor 803 may be of electrical or of some other available construction.

Although the electronic commerce system 123, including the inspection logic 128, 180 (FIG. 1), and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowcharts of FIGS. 6 and 7 show the functionality and operation of an implementation of the inspection logic 128, 180 (FIG. 1) portion of the electronic commerce system 123. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 803 in a computer system or other system. The machine code may be converted from the source code, etc. If embodied in hardware, each block may represent a circuit or a number of interconnected circuits to implement the specified logical function(s).

Although the flowcharts of FIGS. 6 and 7 show a specific order of execution, it is understood that the order of execution may differ from that which is depicted. For example, the order of execution of two or more blocks may be scrambled relative to the order shown. Also, two or more blocks shown in succession in FIGS. 6 and 7 may be executed concurrently or with partial concurrence. Further, in some embodiments, one or more of the blocks shown in FIGS. 6 and 7 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the inspection logic 128, 180 (FIG. 1) portion of the electronic commerce system 123, that comprises software or code can be embodied in any non-transitory computer-readable medium for use by or in connection with an instruction execution system such as, for example, a processor 803 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A non-transitory computer-readable medium embodying a program executable in a computing device, the program comprising:

code that receives an order number for a trade-in order submitted by a customer;

code that renders an interface screen for grading a condition of at least one item that is a subject of the trade-in order, code that receives a graded condition of the at least one item;

code that, in response to receiving the graded condition of the at least one item that meets a specified threshold condition, verifying the at least one item to be an acceptable subject of the trade-in order;

code that, in response to receiving the graded condition that is below the specified threshold condition, commands an image capture device to capture an overhead image in an image file of the item whose graded condition is below the specified threshold condition;

code that stores the image file that is captured to a storage medium available to be accessed by at least the customer; and code that sends a message to the customer with information on the graded condition of the item, wherein the message includes the image file and a model image file of the item whose condition at least meets the specified threshold condition.

2. The computer-readable medium of claim 1, further comprising code that indexes the image file that is captured with information associated with an order item number for the trade-in order corresponding to the item whose graded condition is below the specified threshold condition.

3. The computer-readable medium of claim 1, further comprising code that in response to receiving a graded condition that is downgraded from an initially assessed condition by the customer but is above the specified threshold condition, commands the image capture device to capture a second overhead image of the item.

4. A system, comprising: at least one computing device; and a trade-in inspection program executable in the at least one computing device, the trade-in inspection program comprising:

logic that receives an order number for a trade-in order submitted by a customer;

logic that renders an interface screen for grading a condition of at least one item that is a subject of the trade-in order;

logic that receives a graded condition of the at least one item;

logic that, in response to receiving the graded condition of the at least one item that meets a specified threshold condition, verifying the at least one item to be an acceptable subject of the trade-in order;

logic that, in response to receiving the graded condition that is below the specified threshold condition, commands an image capture device to capture at least one image in an image file of the item whose graded condition is below the specified threshold condition;

logic that stores the image file to a storage medium available to be accessed by at least the customer; and logic that sends a message to the customer with information on the graded condition of the item, wherein the message includes the image file and a model image file of the item whose condition at least meets the specified threshold condition.

5. The system of claim 4, wherein the message is sent in response to receiving a command indicating that grading of the condition of the at least one item of the trade-in order has been completed.

6. The system of claim 4, wherein the image file comprises a video file.

7. The system of claim 4, further comprising logic that indexes the image file that is captured with information associated with an order item number for the trade-in order corresponding to the item whose graded condition is below the specified threshold condition.

8. The system of claim 4, further comprising:

a bar code scanner configured to receive the order number via scanning a bar code tagged to the item.

9. The system of claim 4, further comprising:

logic that, in response to receiving a graded condition that is downgraded from an initially assessed condition by the customer but is above the specified threshold condition, commanding the image capture device to capture a second overhead image of the item.

10. The system of claim 4, further comprising:

a flat work surface upon which to evaluate the item, wherein the flat work surface comprises guide marks indicating where the item may be placed and be properly positioned to be included in an image of the image file that is captured by the image capture device; and a camera support for the image capture device that positions the image capture device over the guide marks of the flat work surface.

11. The system of claim 4, wherein the graded condition is one selected from a group consisting of excellent, good, and average condition designations.

12. A method, comprising the steps of:

receiving, by a computing device, an order number for a trade-in order submitted by a customer;

rendering, by the computing device, an interface screen for grading a condition of at least one item that is a subject of the trade-in order;

receiving a graded condition of the at least one;

in response to receiving the graded condition of the at least one item that meets a specified threshold condition, verifying the at least one item to be an acceptable subject of the trade-in order;

in response to receiving the graded condition that is below the specified threshold condition, commanding, by the computing device, an image capture device to capture at least one image in an image file of the item whose graded condition is below the specified threshold condition;

storing, by the computing device, the image file to a storage medium available to be accessed by at least the customer; and sending a message to the customer with information on the graded condition of the item, wherein the message includes the at least one image that is captured and a model image of the item in a side by side comparison, wherein a condition of the item represented in the model image file at least meets the specified threshold condition.

13. The method of claim 12, wherein the image file comprises a video file.

14. The method of claim 12, further comprising the step of: indexing the image file that is captured with information associated with an order item number for the trade-in order corresponding to the item whose graded condition is below the specified threshold condition.

15. The method of claim 12, wherein the order number is inputted by scanning a bar code tagged to the item.

16. The method of claim 12, further comprising the step of: in response to receiving a graded condition that is downgraded from an initially assessed condition by the customer but is above the specified threshold condition, commanding the image capture device to capture a second overhead image of the item.

17. The method of claim 12, further comprising the step of: designating an area in which the image capture device is focused with guide marks indicating where the item may be placed and be properly positioned to be included in the image that is captured.

18. The method of claim 12, wherein the message is sent in response to receiving a command indicating that grading of the condition of the at least one item of the trade-in order has been completed.

19. The method of claim 12, further comprising the step of: providing a hypertext link to the image file on an interface screen of a customer service representative in charge of handling a dispute with the trade-in order.

20. The method of claim 12, wherein the graded condition is one selected from a group consisting of excellent, good, and average condition designations.

* * * * *

UNITED STATES PATENT AND TRADEMARK OFFICE

CERTIFICATE OF CORRECTION

PATENT NO. : 8,533,055 B1
APPLICATION NO. : 13/172071
DATED : September 10, 2013
INVENTOR(S) : Silas M. Brazil et al.

It is certified that error appears in the above-identified patent and that said Letters Patent is hereby corrected as shown below:

In the Claims

Column 11, line 26, delete "," and insert -- ; -- after the word "order" to read as follows:

-- order; --

Column 12, line 55, insert the word -- item -- after the word "one" to read as follows:

-- receiving a graded condition of the at least one item -- and

Column 13, line 6, delete the word "file" after the word "image" to read as follows:

-- image at least meets the specified threshold condi --

Signed and Sealed this
Twenty-second Day of July, 2014

Michelle K. Lee

Michelle K. Lee
*Deputy Director of the United States Patent and Trademark Office*